US005695919A

United States Patent [19]

Wang et al.

[11] Patent Number: 5,695,919

[45] Date of Patent: Dec. 9, 1997

[54] COATING COMPOSITIONS CONTAINING LUBRICANT-LOADED, NONAQUEOUS DISPERSED POLYMER PARTICLES

[75] Inventors: Yongcai Wang; Charles Chester Anderson, both of Penfield; James Lee Bello, Rochester; Mario Dennis DeLaura, Hamlin, all of N.Y.

[73] Assignee: Eastman Kodak Company, Rochester, N.Y.

[21] Appl. No.: 696,644

[22] Filed: Aug. 12, 1996

[51] Int. Cl.[6] ..... G03C 1/795; G03C 1/805; G03C 1/89; G03C 1/93

[52] U.S. Cl. ..... 430/527; 430/273; 430/262; 430/263; 430/529; 430/531; 430/533; 430/536; 430/537; 430/950; 430/961

[58] Field of Search ..... 430/527, 529, 430/531, 536, 537, 950, 961, 533, 213, 262, 263

[56] References Cited

U.S. PATENT DOCUMENTS

| | | | |
|---|---|---|---|
| 3,880,796 | 4/1975 | Christenson et al. | 260/33.6 R |
| 3,929,693 | 12/1975 | Hochberg | 260/17 R |
| 4,025,474 | 5/1977 | Porter et al. | 260/21 |
| 4,115,472 | 9/1978 | Porter, Jr. et al. | 260/836 |
| 4,134,872 | 1/1979 | Lee | 427/391 |
| 4,147,688 | 4/1979 | Makhlouf et al. | 260/33.6 EP |
| 4,203,769 | 5/1980 | Guestaux | 430/631 |
| 4,336,177 | 6/1982 | Backhouse et al. | 523/201 |
| 4,478,474 | 10/1984 | Gallusser et al. | 339/89 M |
| 4,497,917 | 2/1985 | Upson et al. | 523/201 |
| 4,567,099 | 1/1986 | Van Gilder et al. | 428/327 |
| 4,612,279 | 9/1986 | Steklenski | 430/523 |
| 4,613,633 | 9/1986 | Sekiya et al. | 523/201 |
| 4,683,269 | 7/1987 | Aksman | 525/258 |
| 4,708,923 | 11/1987 | Myers et al. | 430/112 |
| 4,714,671 | 12/1987 | Helling et al. | 430/537 |
| 4,735,976 | 4/1988 | Steklenski et al. | 524/32 |
| 4,758,492 | 7/1988 | Nair | 430/114 |
| 4,820,615 | 4/1989 | Vandenabeele et al. | 430/531 |
| 4,829,127 | 5/1989 | Muramoto et al. | 525/309 |
| 4,977,071 | 12/1990 | Kanetake et al. | 430/534 |
| 5,006,451 | 4/1991 | Anderson et al. | 430/527 |
| 5,366,855 | 11/1994 | Anderson et al. | 430/530 |
| 5,447,832 | 9/1995 | Wang et al. | 430/523 |
| 5,536,628 | 7/1996 | Wang et al. | 430/531 |
| 5,597,680 | 1/1997 | Wang et al. | 430/537 |
| 5,597,681 | 1/1997 | Anderson et al. | 430/537 |

*Primary Examiner*—Richard L. Schilling
*Attorney, Agent, or Firm*—Carl F. Ruoff

[57] ABSTRACT

Imaging elements, such as photographic films and papers, are comprised of a support, an image-forming layer and at least one auxiliary layer containing solvent-dispersible polymer particles. The auxiliary layer having been formed from a coating solution comprising a continuous liquid organic medium having dispersed therein lubricant impregnated core/shell polymer particles, the polymer particles comprising a core portion which is insoluble in the organic medium and a shell portion which has an affinity for both the core portion and the organic medium.

25 Claims, No Drawings

COATING COMPOSITIONS CONTAINING LUBRICANT-LOADED, NONAQUEOUS DISPERSED POLYMER PARTICLES

FIELD OF THE INVENTION

This invention relates in general to imaging elements such as, for example, photographic elements and in particular to imaging elements comprising a support, an image-forming layer and one or more auxiliary layers. More specifically, this invention relates to such imaging elements which have an improved auxiliary layer exhibiting superior physical and manufacturability characteristics.

BACKGROUND OF THE INVENTION

The imaging elements to which this invention relates can be of many different types depending on the particular use for which they are intended. Such elements include, for example, photographic, electrophotographic, electrostatographic, photothermographic, migration, electrothermographic, dielectric recording and themal-dye-transfer imaging elements.

Layers of imaging elements other than the image-forming layer are commonly referred to auxiliary layers. There are many different types of auxiliary layers such as, for example, subbing layers, backing layers, interlayers, overcoat layers, receiving layers, stripping layers, antistatic layers, transparent magnetic layers, and the like.

Support materials for an imaging element often employ auxiliary layers comprising glassy, hydrophobic polymers such as polyacrylates, polymethacrylates, polystyrenes, or cellulose esters, for example. One typical application for such an auxiliary layer is as a backing layer to provide resistance to abrasion, scratching, blocking, and ferrotyping. Such backing layers may be applied directly onto the support material, applied onto a priming or "subbing" layer, or applied as an overcoat for an underlying layer such as an antistatic layer, transparent magnetic layer, or the like. For example, U.S. Pat. No. 4,203,769 describes a vanadium pentoxide-containing antistatic layer that is overcoated with a cellulosic layer applied from an organic solvent. U.S. Pat. Nos. 4,612,279 and 4,735,976 describe organic solvent-applied layers comprising a blend of cellulose nitrate and a copolymer containing acrylic acid or methacrylic acid that serve as overcoats for antistatic layers.

Frequently, when the auxiliary layer serves as the outermost layer, as is the case for a backing layer, it is desirable for this layer to have a low coefficient of friction (COF) to provide proper conveyance properties and to protect the imaging element from mechanical damage during the manufacturing process or customer use. It is known to protect imaging elements against mechanical damage by coating them with a layer comprising a lubricant such as a wax. However, it has proven difficult to provide a single layer applied from organic medium that comprises both an abrasion-resistant polymer and a lubricant since it is difficult to find a coating medium that dissolves both the polymer and the lubricant and is at the same time attractive from an enviromental and health standpoint. In addition, it is difficult to form a stable dispersion of a lubricant such as a wax in an organic medium that may be added to a coating composition containing a dissolved, abrasion-resistant polymer. Therefore, in order to form a backing layer which can be applied from liquid organic medium that is both abrasion-resistant and has a low coefficient of friction one often applies two separate layers; a first layer which is comprised of an abrasion-resistant polymer and then a second layer which is comprised of a lubricant such as a wax. The need to apply these two separate layers increases both manufacturing complexity and cost.

The glassy, hydrophobic polymers that are typically employed in auxiliary layers are normally dissolved in a solvent at very low solids to ensure low coating solution viscosities for good coatability at high coating speeds. Coating techniques employed include 1 to 3 layer extrusion dies (commonly referred to as X-hoppers), air knife, roller coating devices, meyer rods, knife over roll, and so on.

For coating solutions comprising soluble polymers of reasonably high molecular weights, for example, larger than 50,000, the solution viscosity is a strong function of polymer concentration. For example, Elvacite 2041, a methyl methacrylate polymer sold ICI Acrylics Inc., has been described in the photographic art to form protective layers for photograhic materials. The polymer is normally dissolved in an organic solvent such as methylene chloride or alcohol/acetone mixtures to form a clear solution. At concentrations above, for example, 4 to 5 wt %, the Elvacite 2041 solution viscosity is at least 20 cps at ambient temperature. Those viscosity values are too High for coating applications by, for example, X-hopper and air-knife coating techniques, which requires a coating solution viscosity in the range of from one to a few centipoises. Therefore, photographic manufactures have to keep the solids below 3 wt % for low solution viscosities and good coatability at high coating speeds.

Polymer solutions of low solids are useful for applications where lower dry coating coverages (<500 mg/m$^2$) can meet the physical and mechanical properties requirements for that imaging element. More advanced imaging applications need higher dry coating coverages for better physical and mechanical properties. To obtain high dry coating coverages, more coating solution per unit area (wet coverage) has to be applied by using low viscosty/low solids polymer solutions since high viscosity/high solids polymer solutions cannot be coated at low wet coverages at high coating speeds (some coating methods may allow one to coat high viscosity polymer solutions at high wet coverages, but they still suffer from disadvantages mentioned below). In general, higher wet coverages mean more solvent recovery and higher cost for drying. Furthermore, due to both manufacturing limitations and the potential detrimental impact on other physical and mechanical properties of the imaging element, the wet coverages cannot be increased under certain conditions and for certain applications. For example, high coating wet coverages and the high levels of solvent retained in the film support as a result of these high wet coverages may have an adverse impact on both dimensional stability and sensitometric properties of an imaging element. Coating compositions that utilize a low molecular weight polymer in order to provide low solution viscosities at high percent solids may yield a dried layer with inadequate physical and mechanical properties.

Alternative approaches employing low viscosity, dispersed polymer particle-containing coating compositions have been described for paint and automotive coating industries. The use of such compositions in photographic applications has not been disclosed. For example, U.S. Pat. No. 4,336,177 describes a solvent coating composition comprising non-aqueous dispersible composite polymer particles larger than 0.1 μm. The particle has a core with a glass transition temperature (Tg) of about 10° C. less than the polymerization reaction temperature. The particles are stabilized by block or grafting copolymers and can be transferred directly from aqueous medium to a non-aqueous medium. U.S. Pat. No. 4,829,127 describes a coating composition comprising composite resin particles. Such particles are prepared by solution polymerization techniques in reaction vessels containing initiator, solvent, polymerizable monomers, and crosslinked particles. U.S. Pat. No. 3,929,693 describes a coating composition comprising a solution polymer and polymer particles, where the polymer particles have a crosslinked rubbery core below 60° C. and a grafted shell having molecular weight of 1,000 to 150,000. Reportedly, such coating compositions are more stable toward premature separation and flocculation. U.S. Pat. No. 3,880,796 describes a coating composition comprising thermosetting polymer particles containing insoluble microgel particles having a particle size of from 1 to 10 μm. U.S. Pat. No. 4,147,688 describes a dispersion polymerization process of making crosslinked acrylic polymer microparticles having a particle size of from 0.1 to 10 μm. U.S. Pat. No. 4,025,474 describes a coating composition comprising a hydroxyfunctional oil-modified or oil-free polyester resin, aminoplast resin, and 2 to 50% of crosslinked polymer microparticles (0.1 to 10 μm) made by dispersion polymerization process. U.S. Pat. No. 4,115,472 describes a polyurethane coating composition comprising an ungelled hydroxy-containing urethane reaction product and insoluble crosslinked acrylic polymer microparticles (0.1 to 10 μm) made by a dispersion polymerization process. Such coatings are reportedly useful for automotive industries.

There are significant differences in designing coating compositions for photographic applications from those for paint and automotive coating industries. The coating techniques and coating delivery systems are different so that they need different coating rheologies. The drying time in exterior and interior paint and architectural coating applications is on the order of hours and days, and in the automobile industry on the order of 10 to 30 min. However, in the photographic support manufacturing process the drying time for coatings is typically on the order of seconds. Often the drying time for solvent-borne coatings is as brief as 10–30 seconds for high speed coating applications. These differences put additional stringencies on the coating composition for photographic materials. For example, the coating viscosity needs to be on the order of less than 10 cps, and more often less that 5 cps, instead of on the order of one hundred to several thousand cps as in other coating industries. A typical dry coating thickness for photographic materials is on the order of less than 2 μm, and more often less than 1 μm. The film formation and film quality are especially critical. The tolerance on defects caused by polymer gel slugs, gelled particles, dust, and dirt is extemely low. This requires special precautions in delivery processes. The coating solutions need to be very stable toward, for example, high speed filtration and high shear.

Aqueous coating compositions comprising water dispersible polymer particles have been reported to be useful for some applications. For example, they have been used as "priming" or subbing layers on film support to act as adhesion promotion layers for photographic emulsion layers, and used as barrier layers over, for example, a vanadium pentoxide antistatic subbing layer to prevent the loss of antistatic properties after film processing as described in U.S. Pat. No. 5,006,451. While these coating compositions are attractive from environmental considerations, the slow evaporation rate of water coupled with its extremely high heat of vaporization causes drying problems which are either not normally encountered or can be easily overcome in solvent-borne systems. Therefore, for manufacturing processes with conventional organic solvent drying capacity, the use of water-borne coating compositions often leads to very unsatisfactory results. In addition, challenges still exist to develop water-based coatings that provide similar physical and chemical properties in the dried film that can be obtained with organic solvent-based coatings.

Aqueous coating compositions comprising core/shell polymer particles have been disclosed for photographic materials as ferrotyping resistance layers in U.S. Pat. No. 4,497,917, where the polymers are described as having a core with a Tg of greater than 70° C. and a shell with Tg from 25° to 60° C., and as subbing layers in U.S. Pat. No. 4,977,071 and U.S. Reg. No. H1016, where the polymers are described as vinylidene chloride copolymer core/shell latex, U.S. Pat. Nos. 5,447,832 and 5,366,855 describe a coalesced layer for use in imaging elements comprising film-forming colloidal polymer particles and non-film forming colloidal polymer particles. U.S. Pat. No. 5,536,628 describes a coalesced layer for use in imaging elements comprising film-forming colloidal polymer particles and non-film forming colloidal polymer particles in which at least the film-forming colloidal polymer particles or the non-film forming colloidal polymer particles contains a light-absorbing dye. Those layers are coated from aqueous medium and contain polymer particles of both high and low glass transition temperatures. Other aqueous coating compositions that comprise core/shell polymer particles are described in U.S. Pat. Nos. 4,683,269, 4,613,633, 4,567,099, 4,478,974, and 4,134,872. The use of these compositions in photographic films was not disclosed.

U.S. Pat. No. 4,820,615 describes a photographic element having a silver halide emulsion layer that is overcoated with a protective hydrophilic colloid layer containing beads that comprise water-insoluble wax distributed in a hydrophobic polymer.

While the aforementioned prior art references relate to some aspects of the present invention, they are defficient with regard to simultaneously satisfying all the physical, chemical, and manufacturing requirements for providing an improved auxiliary layer for imaging elements that is applied from a liquid organic medium. The present invention provides a coating composition which is stable, has a low viscosity at high percent solids, and forms a dried layer with excellent physical properties such as abrasion resistance and low coefficient of friciton.

SUMMARY OF THE INVENTION

In accordance with the present invention, an image element comprises a support material, such as a polyester, cellulose ester, or resin-coated paper support, having thereon an image-forming layer and one or more auxiliary layers. The auxiliary layer is formed from a coating solution comprising a continuous liquid organic medium having dispersed therein polymer particles, the polymer particles comprising a core portion which is insoluble in the organic medium and is impregnated with a lubricant and a shell portion which has an affinity for both the core portion and the organic medium. The improved auxiliary layer of the invention exhibits superior physical and manufacturability characteristics.

DESCRIPTION OF THE INVENTION

The imaging elements of this invention can be of many different types depending on the particular use for which they are intended. Details with respect to the composition and function of a wide variety of different imaging elements are provided in U.S. Pat. No. 5,300,676 and references described therein.

Photographic elements can comprise various polymeric films, papers, glass, and the like, but both acetate and polyester supports well known in the art are preferred. The thickness of the support is not crtitical. Support thickness of 2 to 10 mil (0.06 to 0.30 millimeters) can be used. The supports typically employ an undercoat or subbing layer well known in the art that comprises, for example, for polyester support a vinylidene chloride/methyl acrylate/itaconic acid terpolymer or vinylidene chloride/acrylonitrile/acrylic acid terpolymer.

The coating compositions utilized herein to form an auxiliary layer of an imaging element comprise a continuous solvent medium having dispersed therein organic polymer particles. The polymer particles comprise a core portion which is insoluble in the organic medium (but may be swellable)and a polymeric shell portion which has an affinity for both the core portion and for the continuous solvent medium. The core portion is impregnated with a lubricant and is insoluble but may be swellable in the solvent medium. The amount of the lubricant incorporated into the polymer particle is from about 1 to 80% by weight, preferably 5 to 50% by weight, and most preferably from 5 to 40% by weight.

The lubricants used for the purpose of the present invention can be any of the known classes of lubricants as decribed, for example, in references such as "The Chemistry and Technology of Waxes", A. H. Warth, 2nd. Ed., Reinhold Publishing Corporation, New York, N.Y., 1956, and "Plastics Additives and Modifiers Handbook", Chapters 54–59, J. Ederibaum (Ed.), Van Nostrand Reinhold, New York, N.Y., 1992. These lubricants include: (1) natural and synthetic waxes including: vegetable waxes such as carnauba wax, animal waxes, insect waxes, petroleum and paraffin waxes; (2) higher fatty acids and derivatives, polyhydric alcohols and derivatives, higher fatty acid esters, higher fatty acid amides, polyhydric alcohol esters of higher fatty acids, and the like disclosed in U.S. Pat. Nos. 2,454,043, 2,732,305, 2,976,148, 3,206,311, 3,933,516, 2,588,765, 3,121,060, 3,502,473, 3,042,222, and 4,427,964, in British Patent Nos. 1,263,722, 1,198,387, 1,430,997, 1,466,304, 1,320,757, 1,320,565, and 1,320,756, and in German Patent Nos. 1,284,295 and 1,284,294; and (3) silicone based materials disclosed, for example, in U.S. Pat. Nos. 3,489,567, 3,080,317, 3,042,522, 4,004,927, and 4,047,958, and in British Patent Nos. 955,061 and 1,143,118.

The shell portion has affinity for both the core portion and for the continuous solvent medium. The first affinity pertains to the ability of the shell molecule to associate with the core portion physically or by covalent bond formation, whereas the affinity for the continuous phase is that the shell molecules are compatible with the continuous solvent phase. The weight of core portion to shell portion is about 90:10 to 30:70, more preferably 80:20 to 40:60, and most preferably 75:25 to 50:50. The core portion has a mean particle size of about from 10 to 500 nm, preferably 10 to 200 μm as measured at its dry state, for example, by electron microscopy.

The auxiliary layer compositions of the present invention are particularly advantageous due to their unique ability to incorporate a lubricant, which may be insoluble in the coating solvent medium, into the coated layer. This eliminates the need to utilize undesirable solvents, such as chlorinated solvents, which are otherwise needed to dissolve the lubricant. During the drying process the lubricant can diffuse out of the polymer particles to the coating surface, thus eliminating the need to apply the lubricant as a separate layer and greatly reducing both manufacturing complexity and cost. The coating compositions have low viscosities at high solids which provide excellent coatability and allow the formation of thick dried layers using reduced wet coating coverages which leads to reduced drying and solvent recovery costs. The resultant layers are equivalent to those coated from polymer solutions in terms of the impermeability to film processing solutions, layer transparency and toughness necessary for providing resistance to scratches, abrasion, blocking, and ferrotyping.

The coating compositions of the invention may contain mixtures of the dispersible polymer particles described above. For example, it may be preferred in some applications to use a mixture consisting of one type of particles having a glassy core and another type of particles having a rubbery core, at least one of the types of polymer particles comprises a core portion which is impregnated with a lubricant as described above. Such a mixture is desired for obtaining, for example, a strong (hard) and tough coating with good optical clarity. The coating composition of the present invention can also contain up to 90%, preferably up to 60% of solution polymers. The solution polymer is defined as those soluble in the desired solvent medium.

In one of the preferred embodiments, the polymer particles are composed of a core portion which is crosslinked by using about 1 to 20 parts of crosslinking agents and a shell portion which is grafted to the core portion by covalent bonding. Such particles can be made as core/shell particles by using, for example, emulsion polymerization processes. One useful technique is the so called sequential emulsion polymerization process (see, for example, Padget, J. C. in Journal of Coating Technology, Vol 66, No. 839, pages 89 to 105, 1994). In this process, the core portion is made with the use of di/trifunctional and grafting comonomers, and the shell portion is made by conducting the polymerization in a monomer starved manner so that the monomer swelling of the core particles is limited. The use of grafting comonomers in the core ensures the formation of sufficient covalent bonds between shell and crosslinked core polymers. The resultant core/shell particles can be isolated by conventional techniques and redispersed in appropriate solvent media.

When the dispersible particles of the present invention are made by sequential polymerization processes, the system is preferred to be designed such that the desired particle morphology is that with the lower total interfacial free energy. This, however, cannot be always the case, as exemplified, for example, by dispersible particles consisting of a highly carboxylated core portion and a much less carboxylated and less hydrophilic shell portion. The overall step in the particle formation process with the desired morphology is thermodynamically unfavorable because the core portion is significantly more hydrophilic than the shell portion. In such cases, techniques by Vanderhoff, Park, and El-Aasser (ACS Symposium Series, 492, 272, 1992), and Lee and Rudin (J. Polym. Sci. Polym. Chem. Ed. 30, 2211, 1992) may be used. For example, the shell portion can be prepared by second stage polymerization at low temperature so that the mobility can be substantially reduced and thermodynamically unfavorable structures obtained.

The dispersible particles of the present invention can also be prepared by: an inverted core/shell-polymerization process, in which the shell portion is prepared first, followed by polymerization of the core monomer in the presence of the shell materials; by attaching preformed shell polymers to the preformed core portion; by grafting polymerization of shell monomers on the core surface, and by dispersing the core polymers in the presence of shell polymers which having affinity for both the core polymers and the solvent medium.

The impregnating of the polymer particles with lubricant can be achieved by a variety of methods. The lubricant impregnated polymer particle can be prepared, for example; by mixing a lubricant with a polymer particle in water with a high shear device at elevated temperatures and passing the resultant emulsion through a high energy homogenizer, by dissolving a lubricant and a polymer in a water immiscible organic solvent and dispersing the resultant solution in water, or by emulsion or suspension polymerization of lubricant/monomer mixtures in water. The lubricant impregnated polymer particles so prepared are then isolated, dried, and redispersed in an appropriate coating solvent.

In one of the preferred embodiments, the lubricant impregnated polymer particles are prepared by sequential emulsion polymerization as previously described. In this process, the first step involves polymerization of a lubricant/monomer mixture to form a core particle. The second step involves preparation of a shell on the core particle by conducting the polymerization of the shell portion in a monomer starved manner. Multifunctional and grafting co-monomers can be used in making the core particle to ensure the formation of sufficient covalent bonds between shell and core polymers. The particles so prepared can be isolated by conventional techniques and redispersed in an appropriate organic solvent medium.

In a second preferred embodiment, the lubricant is first dispersed in water in the presence of a dispersing aid and the resultant dispersion is then used as a "seed" in a seeded emulsion polymerization process in order to prepare the particle core portion. The shell portion can then be prepared as described earlier.

Ethylenically unsaturated monomers which may be used in the core portion of the polymer particles of the present invention may include acrylic monomers, such as acrylic acid, or methacrylic acid, and their alkyl esters such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, the hydroxyalkyl esters of the smae acids such as 2-hydroxyethyl acrylate, 2-hydroxyethyl methacrylate, and 2-hydroxypropyl methacrylate, and the nitrile and amides of the same acids such as acrylonitrile, methacrylonitrile, acrylamide and methacrylamide. Other monomers which may be used, either alone or in admixture with these acrylic monomers, include vinyl acetate, vinyl propionate, vinylidene chloride, vinyl chloride, and vinyl aromatic compounds such as styrene, t-butyl styrene and vinyl toluene. Other comonomers which may be used in conjunction with any of the foregoing monomers include dialkyl maleates, dialkyl itaconates, dialkyl methylene malonates, isoprene, and butadiene.

Preferred crosslinking and grafting comonomers which may be used, in order to crosslink the core portion of the polymer particles and graft the shell portion to the core portion, are monomers which are polyfunctional with respect to the polymerization reaction, including esters of unsaturated monohydric alcohols with unsaturated monocarboxylic acids, such as allyl methacrylate, allyl acrylate, butenyl acrylate, undecenyl acrylate, undecenyl methacrylate, vinyl acrylate, and vinyl methacrylate, dienes such as butadiene and isoprene, esters of saturated glycols or diols with unsaturated monocarboxylic acids, such as ethylene glycol diacrylate, ethylene glycol dimethacrylate, triethylene glycol dimethacrylate, 1,4-butanediol dimethacrylate, 1,3-butanediol dimethacrylate, and polyfunctuional aromatic compounds such as divinyl benzene.

The core portion of the dispersible particles in the present invention can be made in the presence of a certain amount of pre-polymers, or functionalized oligomers, or macromonomers, which may include, for example, functionalized organosiloxanes prepared by reactions between organohydrosiloxane and multifunctional unsaturated monomers, flourine-containing prepolymers, polyester urethanes, polyether urethanes, polyacrylourethanes, and the like.

The core portion of the dispersible particles in the present invention can be rubbery or glassy at room temperature, that is, the glass transition temperature of the core portion can be higher or lower than room temperature. The core portion can contain one phase or two or more incompatible phases. The incompatibility may be determined in various ways known in the art. The use of scanning electron microscopy using staining techniques to emphasize the differences between the appearance of the phases, for example, is such a technique.

The shell portion of the dispersible particle in the present invention may include any polymers which have affinity with both the core portion of the particle and the solvent medium. The role of the polymer is to keep the particles apart so that the attraction force between the particles become insignificant and the stability of the dispersion is retained during storage and under shear (see, for example, Sato T. in Journal of Coating Technology, Vol. 65, No. 825, pages 113 to 121, 1993). The type of polymers that can be used include both homopolymers and copolymers. The shell polymers can be physically attached to the core portion or be chemically attached to the core portion by post polymerization reactions. For example, carboxylic acid groups may be introduced to the core portion through polymerization, and epoxy group-containing monomers may be introduced to the shell portion. The shell polymers are attached to the core portion by ring opening reaction of epoxy groups with carboxylic acid groups. The shell portion can also be introduced by the aforementioned sequential emulsion polymerization process with ethylenically unsaturated monomers. Such monomers may include acrylates including acrylic acid, methacrylates including methacrylic acid, acrylamide and methacrylamide, itaconic acid and its half esters and diesters, styrene including substituted styrenes, acrylonitrile and methacrylonitrile, vinyl acetate, vinyl and vinylidene halides.

The shell polymer of the present invention is properly designed to have good compatibility in the solvent medium. Defining compatibility of the shell molecules in the solvent medium can be achieved by using the concept of "polymer solubility map" (see. for example, Ramsbotham, J, in Progress in Organic Coatings, Vol 8, Pages 113–141, 1980, and Wicks, Jr. Z. W., Jones, F. N, and Papas, S. P. in Organic Coatings, pages 229–239, 1992, John Wiley & Sons, Inc.). As the organic solvent, any of the members customarily used in coating compositions may be satisfactorily used. However, the preferred solvents for the practice of the present invention may include alcohols, esters, ketones, aromatic hydrocarbons, chlorinated solvents, glycols, and their mixtures.

The shell portion of the particles in the present invention may include reactive functional groups capable of forming covalent bonds by intermolecular crosslinking or by reaction with a crosslinking agent. Suitable reactive functional groups include: hydroxyl, carboxyl, carbodiimide, epoxide, aziridine, vinyl sulfone, sulfinic acid, active methylene, amino, amide, allyl, and the like.

The auxiliary layer compositions in accordance with the invention may also contain suitable crosslinking agents that may effectively be used in the coating compositions of the invention including aldehydes, epoxy compounds, polyfunctional aziridines, vinyl sulfones, methoxyalkyl melamines, triazines, polyisocyanates, dioxane derivatives such as dihydroxydioxane, carbodiimides, and the like. The crosslinking agents may react with functional groups present on the dispersible polymer particle, and/or the solution polymer present in the coating composition.

Matte particles well known in the art may also be used in the auxiliary layer compositions of the invention, such matting agents have been described in Research Disclosure No. 308, published December 1989, pages 1008 to 1009. When polymer matte particles are employed, the polymer may contain reactive functional groups capable of forming covalent bonds with the binder polymer by intermolecular crosslinking or by reaction with a crosslinking agent in order to promote improved adhesion of the matte particles to the coated layers. Suitable reactive functional groups include: hydroxyl, carboxyl, carbodiimide, epoxide, aziridine, vinyl sulfone, sulfinic acid, active methylene, amino, amide, allyl, and the like.

Other additional compounds that can be employed in the auxiliary layer compositions of the invention include surfactants, coating aids, inorganic fillers such as non-conductive metal oxide particles, conductive metal oxide particles, carbon black, magnetic particles, pigments, dyes, biocides, UV and thermal stabilizers, and other addenda well known in the imaging art.

The auxiliary layer compositions of the present invention may be applied as solvent coating formulations containing up to 20% total solids by coating methods well known in the art. For example, hopper coating, gravure coating, skim pan/air knife coating, spray coating, and other methods may be used with very satisfactory results. The coatings are dried at temperatures up to 150° C. to give dry coating weights of 20 $mg/m^2$ to 10 $g/m^2$.

In a particularly preferred embodiment, the imaging elements of this invention are photographic elements, such as photographic films, photographic papers or photographic glass plates, in which the image-forming layer is a radiation-sensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly (vinylpyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the elements of the present invention can contain auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in *Research Disclosure,* Item 36544, September, 1994.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in *Research Disclosure,* Item 36544, September, 1994, and the references listed therein.

The photographic silver halide emulsions utilized in this invention can contain other addenda conventional in the photographic art. Useful addenda are described, for example, in *Research Disclosure,* Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The following examples are used to illustrate the present invention. However, it should be understood that the invention is not limited to these illustrative examples.

The examples demonstrate that lubricants can be incorporated into dispersable polymer particles and that coating compositions containing the lubricant impregnated polymer particles exhibit excellent fraction characteristics while providing highly transparent coatings.

EXAMPLES

Example 1

Lubricant Impregnated Polymer Particles Preparation

A stirred reactor containing 625.0 g of deionized water and 33.5 g of 10% by weight Rhone Poulenc Rhodapex CO-436 surfactant was heated to 80° C. and purged with $N_2$ for 1 hour. After addition of 0.5 g of potassium persulfate, an emulsion containing 130.3 g of deionized water, 180.0 g of 25% by weight of Michelman Inc. Michemlube 160 aqueous carnauba wax dispersion, 166.0 g of isobutyl methacrylate, 3.6 g of ethylene glycol dimethacrylate, 9.0 g of allyl methacrylate, 33.5 g of 10% by weight Rhone Poulenc Rhodapex CO-436 surfactant and 0.25 g of potassium persulfate was slowly added over a period of 1 hour. The reaction was allowed to continue for an additional 2 hours. 0.35 g of benzoyl peroxide in 5.0 g of toluene was then added to the reactor. An emulsion containing 350.5 g of deionized water, 22.9 g of 10% by weight Rhone Poulenc Rhodapex CO-436 surfactant, 61.2 g of ethyl methacrylate, 15.3 g of methacrylic acid, and 0.15 g of benzoyl peroxide was added continuously for 1 hour. The reaction was allowed to continue for 3 more hours before the reactor was cooled down to room temperature. The latex prepared was filtered through glass fibre to remove any coagulum.

The latex so made was mixed with acetone at 1:1 ratio to isolate the polymer particles. The precipitate was washed several times with distilled water to remove any residual surfactants and salts. Final drying was in an oven heated to 50° C. The particles prepared contained about 75% by weight core portion and 25% by weight shell portion and the wax content was 20% by weight of the polymer particles. The core portion polymer composition was 93% by weight isobutyl methacrylate, 2% by weight ethylene glycol dimethacrylate, and 5% by weight allyl methacrylate. The shell portion polymer composition was 80% by weight ethyl acrylate and 20% by weight methacrylic acid. These polymer particles are designated as p-1.

Example 2

Lubricant Impregnated Polymer Particles Preparation

Another lubricant impregnated polymer particle was prepared in which the lubricant was used as the seed for the particle core using a seeded emulsion polymerization process. A stirred reactor containing 382.5 g of deionized water, 27.0 g of 10% by weight Rhone Poulenc Rhodapex CO-436 surfactant, and 240.0 g of 25% by weight of Michelman Inc. Michemlube 160 aqueous carnauba wax dispersion was heated to 80° C. and purged with $N_2$ for 1 hour. After addition of 0.5 g of potassium persulfate, an emulsion containing 102.8 g of deionized water, 84.0 g of isobutyl methacrylate, 30.0 g of styrene, 27.0 g of 10% by weight Rhone Poulenc Rhodapex CO-436 surfactant and 0.25 g of potassium persulfate was slowly added over a period of 1 hour. The reaction was allowed to continue for an additional 2 hours. 0.35 g of benzoyl peroxide in 5 g of toluene was then added to reactor. An emulsion containing 444.0 g of deionized water, 36.0 g of 10% by weight Rhone Poulenc Rhodapex CO-436 surfactant, 96.0 of isobutyl methacrylate, 24.0 g of methacrylic acid, and 0.15 g of benzoyl peroxide was added continuously for 1 hour. The reaction was allowed to continue for 3 more hours before the reactor was cooled down to room temperature. The latex prepared was filtered through glass fibre to remove any coagulum.

The latex so made was mixed with acetone at 1:1 ratio to isolate the polymer particles. The precipitate was washed several times with distilled water to remove any residual surfactants and salts. Final drying was in an oven heated to 50° C. The particles prepared contained about 60% by weight core portion and 40% by weight shell portion and the wax content was 20% by weight of the polymer particles. The core portion polymer composition was 70% by weight isobutyl methacrylate and 30% by weight styrene. The shell portion polymer composition was 80% by weight isobutyl methacrylate and 20% by weight methacrylic acid. These polymer particles are designated as p-2.

Core/shell polymer particles were prepared using sequential emulsion polymerization in which the core portion was not impregnated with a lubricant. These particles are designated as p-3 and have a core portion polymer composition of 85% by weight methyl methacrylate, 10% by weight ethylene glycol dimethacrylate, and 5% by weight allyl methacrylate. The shell portion polymer composition was 90% by weight methyl methacrylate and 10% by weight methacrylic acid. These particles contained about 70% by weight core portion and 30% by weight shell portion.

Examples 3–10 and Comparative Sample A

The following examples show that the coating compositions of the invention provide transparent films with excellent frictional characteristics (i.e., low coefficient of friction values) before and after film processing and good abrasion resistance. Coating compositions comprising polymer particles p-1, p-2, or p-3, mixtures of particles p-1 with p-3, mixtures of particles p-2 with p-3, and mixtures of either particles p-1 or p-2 with a solution polymer (nitrocellulose) in a 70/30 acetone/methanol solvent mixture were prepared at 4% solids. These coating compositions all had excellent solution stability and gave transparent, dried layers when applied onto cellulose acetate film support at a dry coating weight of 800 mg/m$^2$. The coefficient of friction (COF) before and after processing in a Graphic Arts (black and white) film processor and the Taber abrasion resistance for the dried coatings were determined using the methods set forth in ANSI IT 9.4-1992 and ASTM D1044, respectively. The compositions and the results for these coatings are listed in Table 1.

TABLE 1

| Coating | Composition | COF before processing | COF after processing | Taber abrasion (% haze) |
|---|---|---|---|---|
| Sample A | particles p-3 | 0.47 | 0.47 | 17.6 |
| Example 3 | particles p-1 | 0.14 | 0.14 | 24.3 |
| Example 4 | particles p-2 | 0.13 | 0.14 | 23.2 |
| Example 5 | 50/50 particles p-1/p-3 | 0.19 | 0.17 | 23.5 |
| Example 6 | 50/50 particles p-2/p-3 | 0.17 | 0.19 | ** |
| Example 7 | 20/80 particles p-1/p-3 | 0.35 | 0.35 | 17.5 |
| Example 8 | 20/80 particles p-2/p-3 | 0.32 | 0.32 | 13.2 |
| Example 9 | 50/50 particles p-1/nitrocellulose | 0.17 | 0.15 | 31.1 |
| Example 10 | 50/50 particles p-2/nitrocellulose | 0.15 | 0.15 | 22.1 |

**not measured.

As shown by the above examples, the coating compositions of the present invention, namely, coating compositions containing a liquid organic medium as a continuous phase and lubricant impregnated core/shell polymer particles as a dispersed phase, are capable of forming a continuous film that is transparent and has excellent functional characteristics. Any of a wide variety of auxiliary layers commonly incorporated in imaging elements can be improved in performance characteristics by use of the lubricant impregnated core/shell polymer particles.

Examples 11–12 and Comparative Sample B

The following examples demonstrate that the coating compositions of the invention are effective overcoats for an antistatic layer which simultaneously prevent the loss of antistatic properties during film processing and provide low coefficient of friction values. A coating composition comprising a mixture of particles p-1 with p-3 and an aziridine crosslinking agent, were applied onto a vanadium pentoxide-containing antistatic layer that had been previously coated onto either a 4 mil thick polyester support or a 5 mil thick cellulose acetate support. The overcoat layer was applied at a dry coating weight of 800 mg/m$^2$. The coefficient of friction values were determined as previously described. The permanance of the antistatic properties was determined by comparing the internal resistivity (using the salt bridge method, described in R. A. Elder, "Resistivity Measurements on Buried Conductive Layers", EOS/ESD Symposium Proceedings, September 1990, pages 251–254.) for the samples at 20% relative humidity before and after film processing in a Graphic Arts film processor. The description of the coatings and the results are listed in Table 2.

TABLE 2

| Coating | Composition of Overcoat | Support | Resistivity before processing | Resistivity after processing | COF |
|---|---|---|---|---|---|
| Sample B | none | polyester | $3 \times 10^7$ Ω/□ | $>1 \times 10^{14}$ Ω/□ | 0.45 |
| Example 11 | 50/50 particles p-1/p-3, with aziridine crosslinker* | cellulose acetate | $3 \times 10^7$ Ω/□ | $3 \times 10^7$ Ω/□ | 0.22 |
| Example 12 | 50/50 particles p-1/p-3, with aziridine crosslinker* | polyester | $3 \times 10^7$ Ω/□ | $3 \times 10^7$ Ω/□ | 0.33 |

*aziridine concentration at 10% by weight of the overcoat layer. Aziridine is CX100 polyfunctional aziridine supplied by Zeneca Resins.

This invention has been described in detail with particular reference to certain preferred embodiments thereof, but it should be understood that variations and modifications can be effected within the spirit and scope of the invention

What is claimed is:

1. An imaging element for use in an image-forming process; said imaging element comprising a support; an image-forming layer and an auxiliary layer; said auxiliary layer having been formed from a coating solution comprising a continuous liquid organic medium having dispersed therein polymer particles, said polymer particles comprising a core portion impregnated with a lubricant which is insoluble in said organic medium and a shell portion which has affinity for both said core portion and said organic medium.

2. An imaging element as claimed in claim 1, wherein said lubricant is selected from the group consisting of vegetable wax, animal wax, insect wax, petroleum, paraffin wax, higher fatty acids and derivatives, polyhydric alcohols and derivatives, fatty acid esters, fatty acid amides, polyhydric alcohols of higher fatty acids, and silicone containing materials.

3. An imaging element as claimed in claim 1, wherein said element is a photographic element.

4. An imaging element as claimed in claim 1, wherein said auxiliary layer is a subbing layer, backing layer, interlayer, overcoat layer, receiving layer, barrier layer, stripping layer, mordanting layer, scavenger layer, antikinking layer or transparent magnetic layer.

5. An imaging element as claimed in claim 1, wherein said support is an acetate film support.

6. An imaging element as claimed in claim 1, wherein said support is a polyester film support.

7. An imaging element as claimed in claim 1, wherein said image-forming layer is a silver halide emulsion layer.

8. An imaging element as claimed in claim 1, wherein said image-forming layer is a thermally-processable imaging layer.

9. An imaging element as claimed in claim 1, wherein the weight ratio of the core portion to the shell portion of said polymer particles is 75:25 to 50:50.

10. An imaging element as claimed in claim 1, wherein the core portion of said polymer particles has a mean particle size of about 10 to about 200 nm.

11. An imaging element as claimed in claim 1, wherein said auxiliary layer comprises a mixture of polymer particles having a glassy core and polymer particles having a rubbery core.

12. An imaging element as claimed in claim 1, wherein said dispersion of polymer particles contains up to 90 percent by weight of solution polymer.

13. An imaging element as claimed in claim 1, wherein said polymer particles are composed of a core portion which is crosslinked by a crosslinking agent and a shell portion which is grafted to said core portion by covalent bonding.

14. An imaging element as claimed in claim 1, wherein said core portion of said polymer particles is formed from a crosslinked polymer of at least one ethylenically-unsaturated monomer.

15. An imaging element as claimed in claim 1, wherein said shell portion of said polymer particles is formed from at least one acrylic monomer.

16. An imaging element as claimed in claim 1, wherein said shell portion of said polymer particles is formed from at least one monomer which contains hydrophilic functionality.

17. An imaging element as claimed in claim 1, wherein said shell portion of said polymer particles is formed from at least one monomer which contains carboxylic acid groups.

18. An imaging element as claimed in claim 1, wherein said dispersion includes a crosslinking agent.

19. An imaging element as claimed in claim 1, wherein said liquid organic medium is selected from the group consisting of alcohols, esters, ketones, aromatic hydrocarbons, chlorinated solvents, glycols and mixtures thereof.

20. An imaging element as claimed in claim 1, wherein said core portion of said polymer particles is comprised of an interpolymer of isobutyl methacrylate, ethylene glycol dimethacrylate and allyl methacrylate and said shell portion of said polymer particles is comprised of a copolymer of ethyl methacrylate and methacrylic acid.

21. An imaging element as claimed in claim 1, wherein said core portion of said polymer particles is comprised of an interpolymer of isobutyl meth-acrylate and styrene, and said shell portion of said polymer particles is comprised of a interpolymer of isobutyl methacrylate and methacrylic acid.

22. An imaging element as claimed in claim 1, including a protective overcoat layer containing matte particles and a lubricant.

23. An imaging element as claimed in claim 1, wherein said auxiliary layer is an antistatic layer containing a conductive metal oxide.

24. An imaging element as claimed in claim 1, wherein said auxiliary layer is an antistatic layer containing a conductive polymer.

25. An imaging element as claimed in claim 1, wherein said auxiliary layer is a magnetic layer containing magnetic recording particles.

* * * * *